US008176687B2

(12) United States Patent
Roque Alonso

(10) Patent No.: US 8,176,687 B2
(45) Date of Patent: May 15, 2012

(54) GUTTER SYSTEM AND ASSOCIATED METHODS

(76) Inventor: Ramon R. Roque Alonso, Cumming, GA (US)

( * ) Notice: Subject to any disclaimer, the term of this patent is extended or adjusted under 35 U.S.C. 154(b) by 167 days.

(21) Appl. No.: 12/701,898

(22) Filed: Feb. 8, 2010

(65) Prior Publication Data

US 2010/0251626 A1 Oct. 7, 2010

Related U.S. Application Data

(60) Provisional application No. 61/211,854, filed on Apr. 3, 2009.

(51) Int. Cl.
*E04D 13/00* (2006.01)
*E04D 13/08* (2006.01)

(52) U.S. Cl. ..... 52/12; 52/11; 52/13; 52/14; 52/15; 52/16

(58) Field of Classification Search ..... 52/11–16, 52/741.3; 248/48.2
See application file for complete search history.

(56) References Cited

U.S. PATENT DOCUMENTS

| | | | | |
|---|---|---|---|---|
| 5,040,750 | A * | 8/1991 | Brant | 248/48.2 |
| 5,575,118 | A * | 11/1996 | Vahldieck | 52/11 |
| 5,617,678 | A * | 4/1997 | Morandin et al. | 52/11 |
| 5,737,879 | A * | 4/1998 | Sweet | 52/12 |
| 5,845,435 | A * | 12/1998 | Knudson | 52/11 |
| 5,878,533 | A * | 3/1999 | Swanfeld, Jr. | 52/11 |
| 6,182,399 | B1 * | 2/2001 | Pollera | 52/11 |
| 6,732,477 | B1 * | 5/2004 | Richard | 52/12 |
| 7,117,643 | B2 * | 10/2006 | Brown | 52/12 |
| 7,707,781 | B2 * | 5/2010 | Van Cleave et al. | 52/11 |
| 2003/0029129 | A1 * | 2/2003 | Walters | 52/741.1 |
| 2004/0000098 | A1 * | 1/2004 | Knudson | 52/12 |
| 2004/0244304 | A1 * | 12/2004 | Bullinger | 52/12 |
| 2005/0000167 | A1 * | 1/2005 | Richard et al. | 52/11 |
| 2005/0082436 | A1 * | 4/2005 | Snell | 248/48.2 |
| 2005/0115158 | A1 * | 6/2005 | Brown | 52/11 |
| 2005/0115190 | A1 * | 6/2005 | Brown | 52/720.1 |
| 2006/0201069 | A1 * | 9/2006 | Richard et al. | 52/12 |
| 2007/0094940 | A1 * | 5/2007 | Pijanowski | 52/12 |
| 2007/0119104 | A1 * | 5/2007 | Pijanowski | 52/11 |
| 2008/0000169 | A1 * | 1/2008 | Handley | 52/12 |
| 2008/0120921 | A1 * | 5/2008 | McDonald et al. | 52/12 |
| 2009/0019786 | A1 * | 1/2009 | Bachman | 52/12 |
| 2009/0235592 | A1 * | 9/2009 | Knudson et al. | 52/12 |
| 2009/0249703 | A1 * | 10/2009 | Desotell et al. | 52/12 |
| 2010/0242376 | A1 * | 9/2010 | Dowling et al. | 52/12 |
| 2011/0114800 | A1 * | 5/2011 | Gramling | 248/48.2 |
| 2011/0126477 | A1 * | 6/2011 | Hurn | 52/12 |
| 2011/0138696 | A1 * | 6/2011 | Olson et al. | 52/12 |
| 2011/0138697 | A1 * | 6/2011 | Martin | 52/12 |

* cited by examiner

*Primary Examiner* — Mark Wendell
(74) *Attorney, Agent, or Firm* — Bradley D. Crose; Crose Law LLC

(57) ABSTRACT

A gutter system is provided to guard a gutter from the entry of leaves, debris, pine needles, twigs, and the like, and to prevent water and animals from entry. In at least one embodiment, a hanger bracket is configured to secure a gutter to a building, and configured to secure an upper gutter cover and a lower gutter cover, in a tiered, stair-step manner, to the gutter. In another embodiment a gutter system is provided that includes a gutter, an upper gutter cover, a lower gutter cover, and a hanger bracket configured to secure the gutter to a building having a roof and rainwater runoff, and configured to secure the upper gutter cover and the lower gutter cover, in a tiered, stair-step manner, to the gutter. In yet another embodiment a method for protecting gutters from debris other than rainwater runoff is provided.

19 Claims, 8 Drawing Sheets

GUTTER SYSTEM AND ASSOCIATED METHODS

CROSS-REFERENCE TO RELATED APPLICATION(S)

The present non-provisional patent application claims the benefit of priority of U.S. Provisional Patent Application No. 61/211,854, which is entitled "GUTTER MATE SYSTEMS", which was filed on Apr. 3, 2009, and which is incorporated in full by reference herein.

FIELD OF THE INVENTION

The technology described herein relates generally to gutters, gutter guards, gutter hangers and supports, gutter systems, and the like. More specifically, this technology relates to a device, system, and associated methods to guard a gutter from the entry of leaves, debris, pine needles, twigs, and the like, and to prevent water and rodents and other animals from entry into the home in and around the gutter system.

BACKGROUND OF THE INVENTION

A common problem with rainwater gutters is that they can become clogged and/or blocked in such a way that they prevent the free flow of runoff rainwater draining from the roof. Gutters often fill with leaves, debris, pine needles, twigs, and the like, in addition to the rainwater they are to drain. Once full of such debris, or otherwise clogged, the gutters no longer allow for the free flow and drainage of water. The prevention of such a problem often requires the periodic, manual maintenance of the gutters to prevent or remove the clogging by debris. To skip such required maintenance can lead to damage to the gutter system and building upon which the gutter system in installed. Severely blocked or clogged gutters can cause ice dams, gutter and downspout damage, wood damage to the building, water entry into the home, and the like.

Gutter guard systems are utilized to prevent rainwater gutters from becoming blocked and/or clogged to the point that they prevent the free flow of rainwater runoff from the roof into a gutter trough. Known gutter guard systems include screens and meshes. Known gutter guard systems include those that directly interconnect or touch the shingles of the roof.

BRIEF SUMMARY OF THE INVENTION

In various exemplary embodiments, the technology described herein provides a device, system, and associated methods to guard a gutter from the entry of leaves, debris, pine needles, twigs, and the like, and to prevent water and rodents and other animals from entry into the home in and around the gutter system In one exemplary embodiment, the technology described herein provides a gutter system hanger. The gutter system hanger includes a hanger bracket configured to secure a gutter to a building having a roof and rainwater runoff, and configured to secure an upper gutter cover and a lower gutter cover, in a tiered, stair-step manner, to the gutter to guard the gutter from entry of leaves, debris, pine needles, twigs, and the like, and to prevent water and rodents and other animals from entry into the building in and around the gutter. The gutter system also includes an upper hanger round defined upon the hanger bracket and configured to receive the upper gutter cover and create a first entry point for water into the gutter. The gutter system further includes a lower hanger round defined upon the hanger bracket and configured to receive the lower gutter cover and create a second entry point for water into the gutter.

The gutter system can further include at least one hanger mount defined upon a back side of the hanger bracket and with which to secure the hanger bracket to a fascia board on the building.

The gutter system can further include at least one channel defined within the hanger bracket in which to receive a mount screw and with which to secure the hanger bracket to a fascia board on the building.

The gutter system can further include an upper cover channel defined within the hanger bracket and configured to receive an upper edge of the upper gutter cover and a lower cover channel defined within the hanger bracket and configured to receive an upper edge of the lower gutter cover.

The gutter system can still further include an upper cover tuck area defined within the hanger bracket and configured to receive a lower edge of the upper gutter cover and a lower cover tuck area defined within the hanger bracket and configured to receive a lower edge of the lower gutter cover.

In various embodiments the hanger bracket is manufactured from a metal selected from aluminum, copper, steel, or the like. Alternatively, the hanger bracket is manufactured from a thermoplastic material. In at least one embodiment, the hanger bracket is manufactured from acrylonitrile butadiene styrene (ABS).

In another exemplary embodiment, the technology described herein provides a gutter system. The gutter system includes a gutter, an upper gutter cover, a lower gutter cover, and a hanger bracket configured to secure the gutter to a building having a roof and rainwater runoff, and configured to secure the upper gutter cover and the lower gutter cover, in a tiered, stair-step manner, to the gutter to guard the gutter from entry of leaves, debris, pine needles, twigs, and the like, and to prevent water and rodents and other animals from entry into the building in and around the gutter.

The gutter system can include an upper hanger round defined upon the hanger bracket and configured to receive the upper gutter cover and create a first entry point for water into the gutter. The gutter system can also include a lower hanger round defined upon the hanger bracket and configured to receive the lower gutter cover and create a second entry point for water into the gutter.

The gutter system can include an end cap for use in a gutter section defined as an end, wherein the end cap further is defined with an upper round, a lower round, and a gutter end shape to enable a secure, sealed fit.

The gutter system can also include a high back defined by the placement of the hanger bracket and the gutter against a fascia board such that a surface directly against the fascia board forms the high back configured to prevent water from entering the area behind the gutter system and preventing rodents, or the like, from entering the building.

In at least one embodiment the gutter, the upper gutter cover, and the lower gutter are seamless.

The gutter system can also include at least one hanger mount disposed upon a back side of the hanger bracket and with which to secure the hanger bracket to a fascia board on the building.

The gutter system can also include at least one channel defined within the hanger bracket in which to receive a mount screw and with which to secure the hanger bracket to a fascia board on the building.

The gutter system can also include an upper cover channel defined within the hanger bracket and configured to receive an upper edge of the upper gutter cover and a lower cover channel defined within the hanger bracket and configured to receive an upper edge of the lower gutter cover.

The gutter system can also include an upper cover tuck area defined within the hanger bracket and configured to receive a lower edge of the upper gutter cover and a lower cover tuck area defined within the hanger bracket and configured to receive a lower edge of the lower gutter cover.

In another exemplary embodiment, the technology described herein provides a method for protecting gutters from debris other than rainwater runoff. The method includes installing a gutter system comprising a gutter, an upper gutter cover, a lower gutter cover, and a hanger bracket configured to secure the gutter to a building having a roof and rainwater runoff, and configured to secure the upper gutter cover and the lower gutter cover, in a tiered, stair-step manner, to the gutter to guard the gutter from entry of leaves, debris, pine needles, twigs, and the like, and to prevent water and rodents and other animals from entry into the building in and around the gutter. The method also includes securing the gutter to the building with the hanger bracket. The method further includes securing the upper gutter cover and the lower gutter cover to the hanger bracket and above the gutter in a tiered, stair-step manner, to guard the gutter.

The method also includes installing the gutter, the upper gutter cover, and the lower gutter cover seamlessly. The method further includes installing the gutter, the upper gutter cover, and the lower gutter cover without touching and connectivity to any shingles on the roof.

The method also includes installing the gutter, the upper gutter cover, and the lower gutter cover and allowing an approximate one-eighth inch gap between the gutter and the upper gutter cover to prevent water return.

Advantageously, the technology described herein provides a vastly improved gutter system that provides protection from entry of leaves, debris, pine needles, twigs, and the like, and prevents water and rodents and other animals from entry into the home in and around the gutter system.

Also advantageously, the gutter system described herein provides maintenance-free, seamless gutters that prevent clogging of debris, prevent ice dams from forming and damaging the gutters, and help prevent mold from forming in attics and basements.

Further advantageously, the gutter system provides for the free flow of water within the gutters, allowing water to flow freely without obstruction from leaves, debris, and the like.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
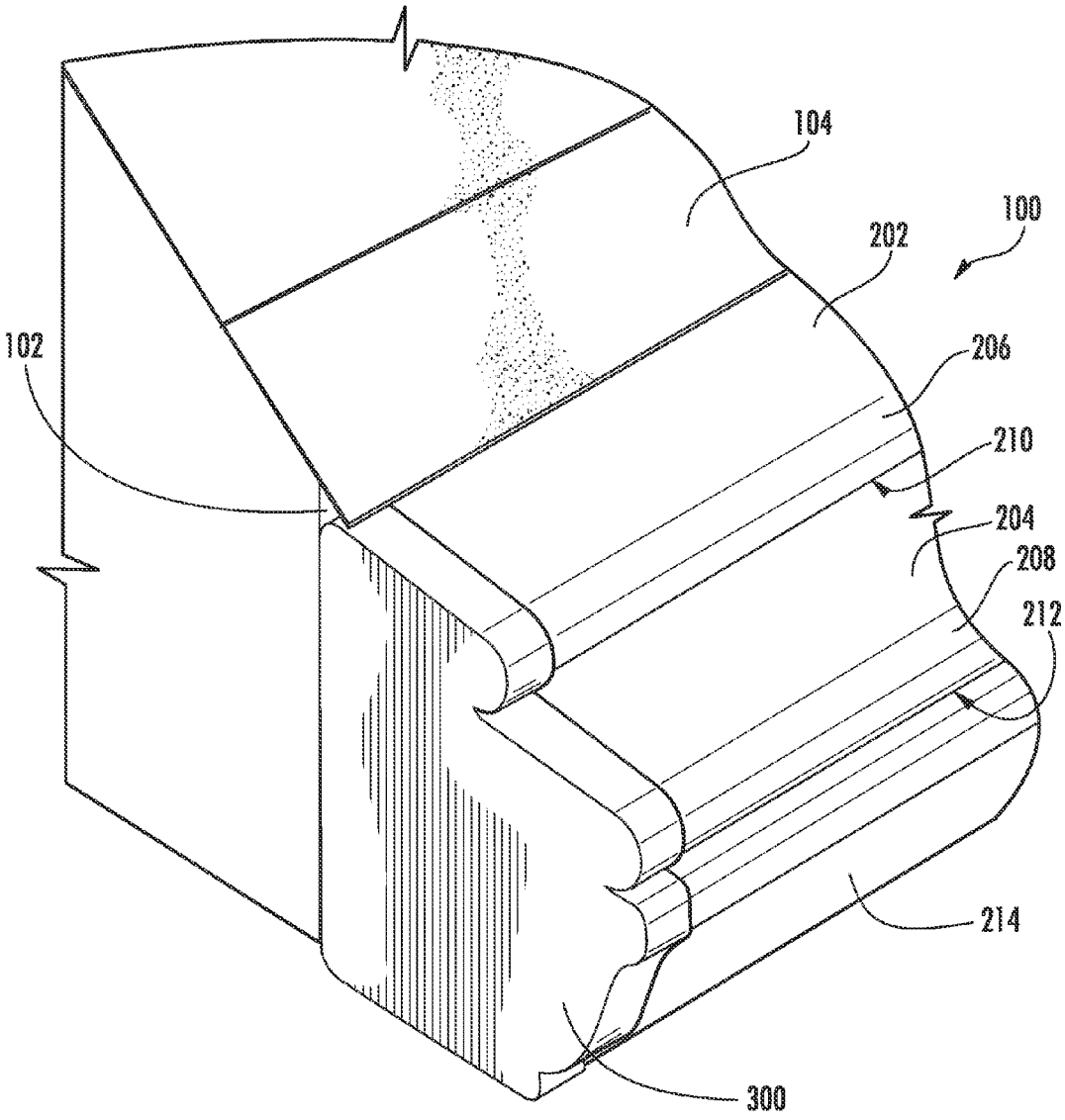
FIG. 1 is a front perspective view of a gutter system, illustrating, in particular, the double rounded cover protection to slow water flow and reduce overwash, according to an embodiment of the technology described herein.
Figure 2:
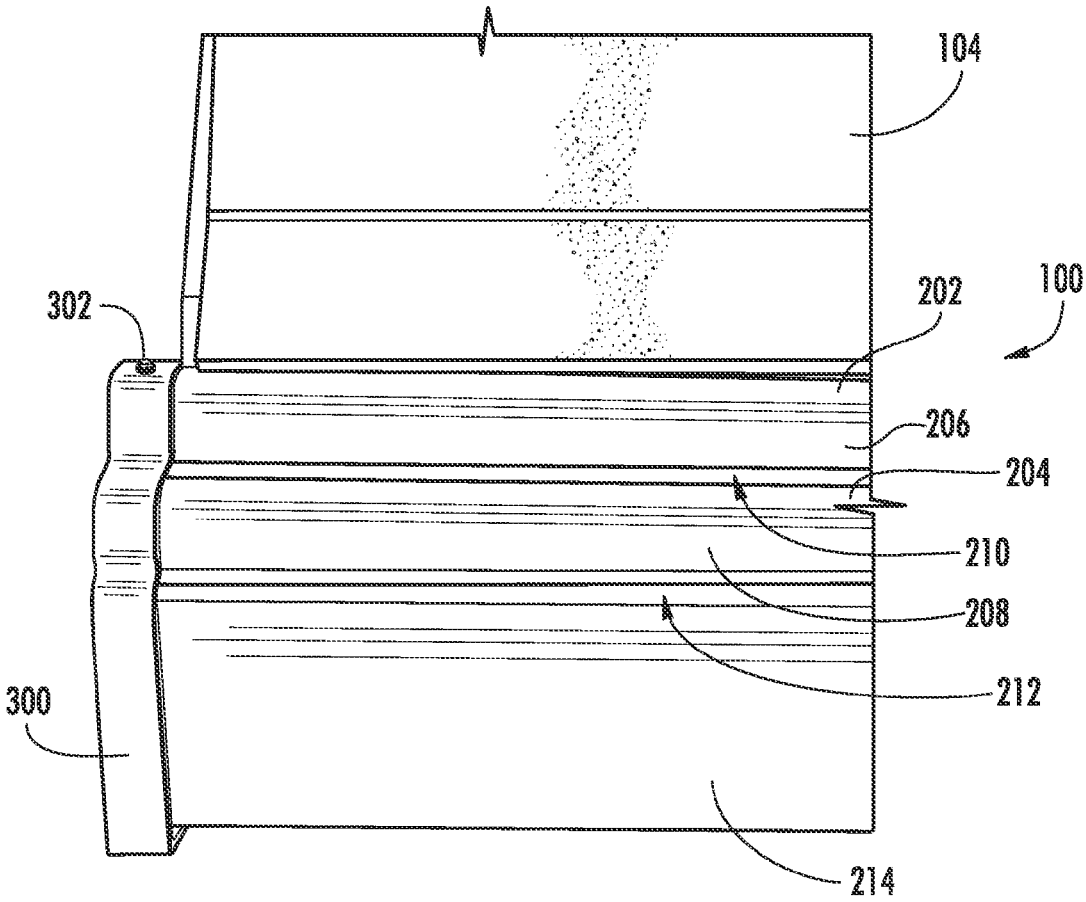
FIG. 2 is a front view of the gutter system depicted in FIG. 1 illustrating, in particular, installation relative to a fascia board and shingles.
Figure 3:
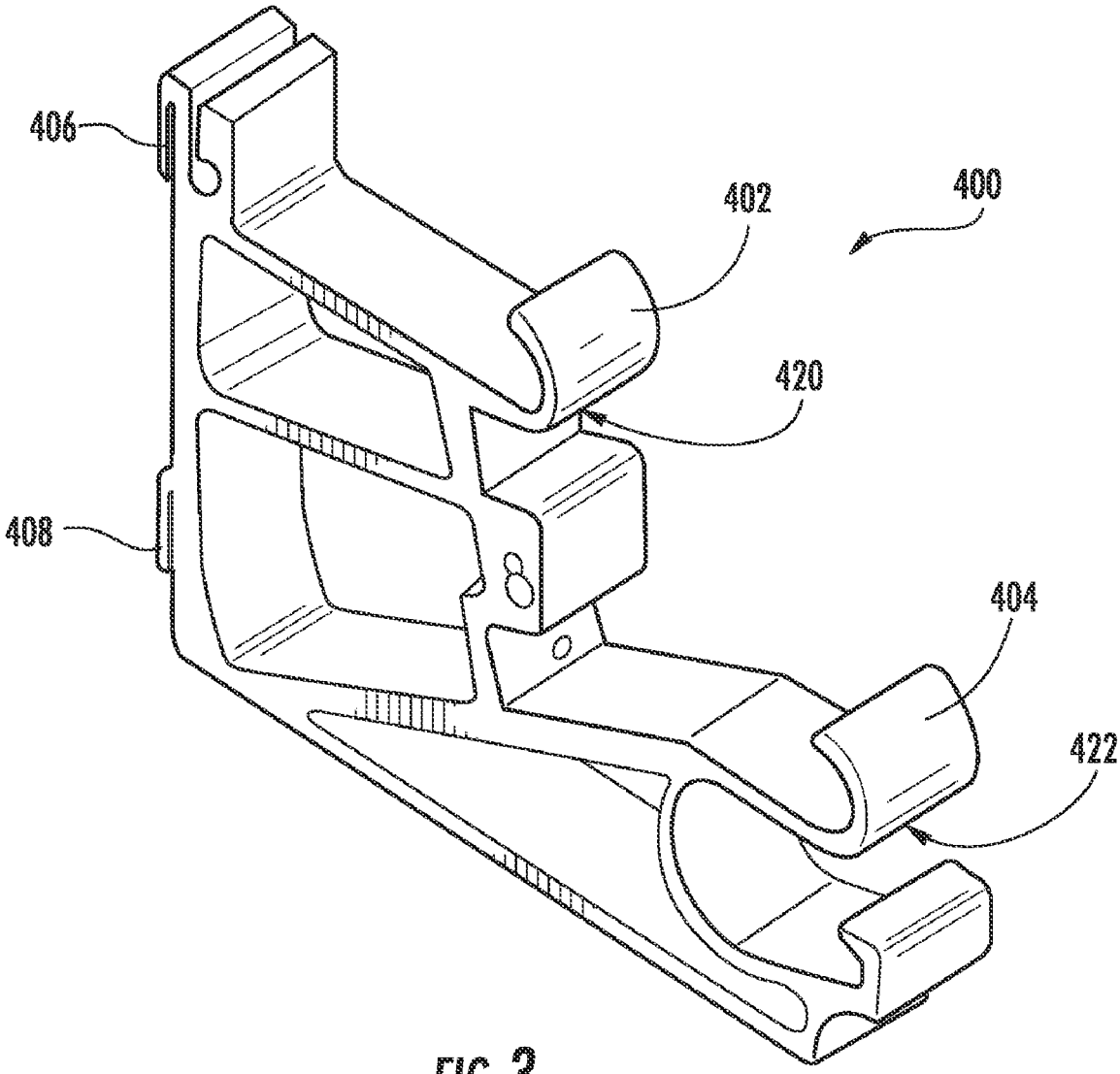
FIG. 3 is a front perspective view of a gutter system hanger, illustrating, in particular, hanger rounds, tuck areas, and mounts, according to an embodiment of the technology described herein.
Figure 4:
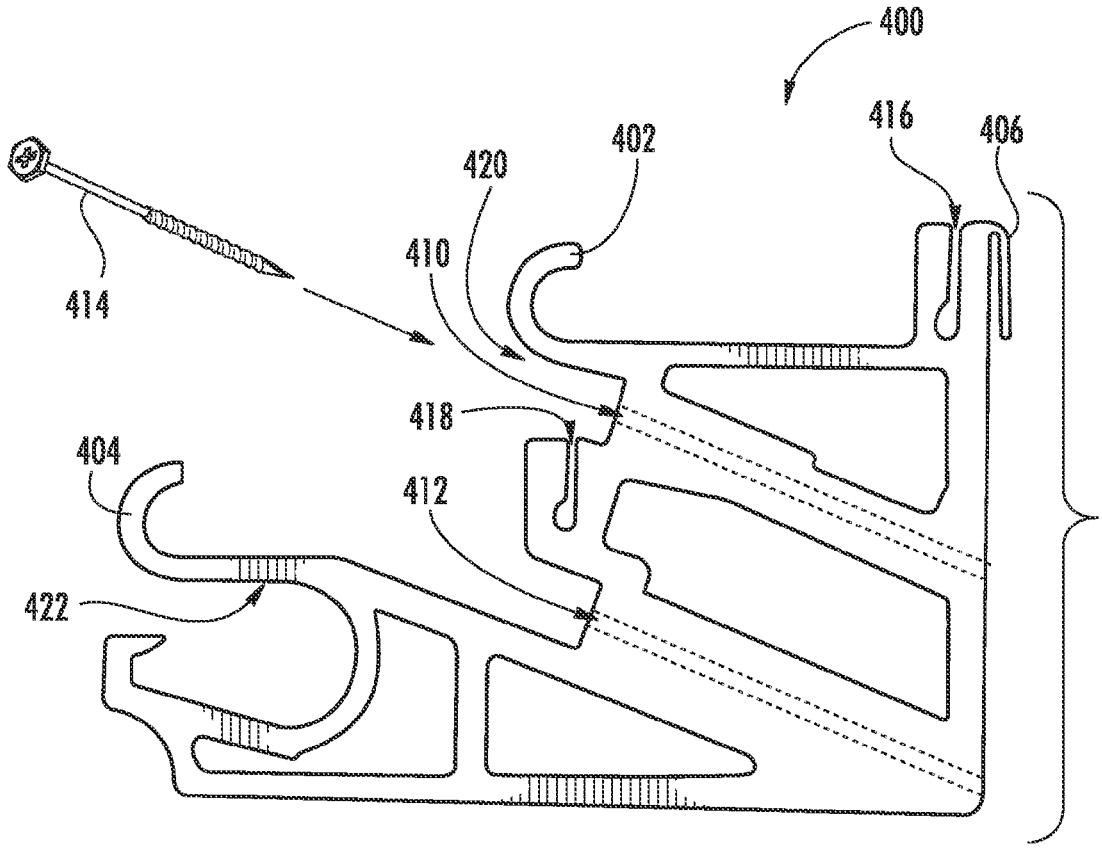
FIG. 4 is a side view of the gutter system hanger depicted in FIG. 3, illustrating, in particular, the upper and lower screw channels and the upper and lower cover channels, according to an embodiment of the technology described herein.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a device, system, and associated methods to guard a gutter from the entry of leaves, debris, pine needles, twigs, and the like, and to prevent water and rodents and other animals from entry into the home in and around the gutter system.

Referring now to the Figures a gutter system 100 is shown. The gutter system 100 includes a hanger bracket 400. The hanger bracket 400 is configured to secure a gutter 214 to a building having a roof and rainwater runoff. The gutter 214 is secured to the building against a fascia board 102. The gutter 214 is secured to the building under shingles 104, without touching or requiring contact with the shingles 104.

The hanger bracket 400 can vary in dimensions and spacing. By way of example, the hanger bracket 400 can be manufactured with a width of approximately one half inch and placed approximately every twenty four inches along the gutter path as it is installed.

In various embodiments the hanger bracket 400 is manufactured from a metal material. By way of example, the hanger bracket 400 can be manufactured from aluminum, copper, steel, or the like. Alternatively, the hanger bracket 400 can be manufactured from a thermoplastic material. In at least one embodiment, the hanger bracket 400 is manufactured from the thermoplastic material acrylonitrile butadiene styrene (ABS).

The hanger bracket 400 also is configured to secure an upper gutter cover 202 and a lower gutter cover 204. The upper gutter cover 202 and the lower gutter cover 204 are seamless. The upper gutter cover 202 and the lower gutter cover 204 are configured with a solid, thin material; they are not a mesh or screen material. The upper gutter cover 202 and the lower gutter cover 204 run the length of the gutter 214 which they cover. The upper gutter cover 202 and the lower gutter cover 204 are configured and installed in a tiered, stair-step manner, to the gutter to guard the gutter 214 from entry of leaves, debris, pine needles, twigs, and the like, and to prevent water and rodents and other animals from entry into the building in and around the gutter 214.

In various embodiments the upper gutter cover 202 and the lower gutter cover 204 are manufactured from a metal material. By way of example, the upper gutter cover 202 and the lower gutter cover 204 can be manufactured from aluminum, copper, steel, or the like. Alternatively, the upper gutter cover 202 and the lower gutter cover 204 can be manufactured from a thermoplastic material. In at least one embodiment, the upper gutter cover 202 and the lower gutter cover 204 are manufactured from the thermoplastic material acrylonitrile butadiene styrene (ABS).

The gutter system 100 also includes an upper hanger round 402 defined upon the hanger bracket 400. The upper hanger round 402 is configured to receive the upper gutter cover 202 at upper cover round 206. The placement of the upper gutter cover 202 at the upper cover round 206 about the upper hanger round 402 creates a first entry point 210 for water to enter into the gutter 214 along the length of the upper gutter cover 202. The upper hanger round 402 can be integrally formed within the hanger bracket 400.

The gutter system 100 further includes a lower hanger round 404 defined upon the hanger bracket 400. The lower hanger round 404 is configured to receive the lower gutter cover 204 at lower cover round 208. The placement of the lower gutter cover 204 at the lower cover round 208 about the lower hanger round 404 creates a second entry point 212 for water to enter into the gutter 214 along the length of the lower gutter cover 204. The lower hanger round 404 can be integrally formed within the hanger bracket 400.

The gutter system 100 further includes at least one hanger mount 406, 408 defined upon a back side of the hanger bracket 400. By way of example, the hanger mount 406, 408 is utilized to secure the hanger bracket 400 to a fascia board 102 on the building. The underside of the hanger mount 406, 408 can also be utilized in the hanging of the gutter 214 and securing the gutter 214 to the hanger bracket 400.

The gutter system 100 further includes at least one channel 410, 412 defined within the hanger bracket 400. Each channel 410, 412 of the hanger bracket 400 is configured to receive a mount screw 414 and is utilized to secure the hanger bracket 400 to a fascia board 102 on the building. By way of example, the mount screw 414 can be a four-inch wood screw to securely mount the hanger bracket 400, and entire gutter system 100, to the fascia board 102.

The gutter system 100 can also include an upper cover channel 416. The upper cover channel 416 is defined within the hanger bracket 400 and is configured to receive an upper edge of the upper gutter cover 202. The upper cover channel 416 secures the upper gutter cover 202 in place.

The gutter system 100 can further include a lower cover channel 418. The lower cover channel 418 is defined within the hanger bracket 400 and is configured to receive an upper edge of the lower gutter cover 204. The lower cover channel 418 secures the lower gutter cover 204 in place.

The gutter system 100 also can include an upper cover tuck area 420 defined within the hanger bracket 400. The upper cover tuck area 420 is configured to receive a lower edge of the upper gutter cover 202. The upper cover tuck area 420 provides an additional means by which to secure the upper gutter cover 202 in place.

The gutter system 100 further can include lower cover tuck area 422 defined within the hanger bracket 400. The lower cover tuck area 422 is configured to receive a lower edge of the lower gutter cover 204. The lower cover tuck area 422 provides an additional means by which to secure the lower gutter cover 204 in place.

The gutter system 100 also includes an end cap 300 for use at a gutter 214 section defined as an end. The end cap 300 can be secured to portions of the gutter system 100 utilizing, for example, one or more end cap screws 302.

The end cap 300 is defined with an upper round 308 and a lower round 310 to match the ends of the upper gutter cover 202 and the lower gutter cover 204, respectively. The upper round 308 and the lower round 310 provide structural support and help maintain the curvature of the upper cover round 206 of the upper gutter cover 202 and the lower cover round 208 of the lower gutter cover 204.

The end cap 300 is defined with an end panel 304 to prevent the flow of water in that direction. The end cap 300 also is defined with a rim 306 to correspond with the gutter 214, the upper gutter cover 202, and the lower gutter cover 204 and secure a sealable fit to prevent the leakage or passage of water.

The gutter system 100 also includes a high back 216. The high back 216 is defined by the placement of the hanger bracket 400 and the gutter 214 against a fascia board 102 such that a surface directly against the fascia board 102 forms the high back 216. The high back 216 is configured to prevent water from entering the area behind the gutter system 100 and preventing rodents, or the like, from entering the building.

The gutter system 100 is installed such that the gutter 214, the upper gutter cover 202, the lower gutter cover 204, and the end cap 300 do not touch any shingles 104 on the roof.

The gutter system 100 is installed to provide an approximate one-eighth inch gap 218 between the gutter 214 and the upper gutter cover 202 to prevent water return. The gap 218 can vary in application as is appropriate for installation so long as the prevention of water return into the building is maintained.

A method of installing a gutter system 100 is disclosed. A method for protecting gutters 214 from debris other than rainwater runoff includes the step of installing a gutter system 100 having a gutter 214, an upper gutter cover 202, a lower gutter cover 204, and a hanger bracket 400 configured to secure the gutter 214 to a building having a roof and rainwater runoff, and configured to secure the upper gutter cover 202 and the lower gutter cover 204, in a tiered, stair-step manner, to the gutter 214 to guard the gutter 214 from entry of leaves, debris, pine needles, twigs, and the like, and to prevent water and rodents and other animals from entry into the building in and around the gutter 214, securing the gutter 214 to the building with the hanger bracket 400, and securing the upper gutter cover 202 and the lower gutter cover 204 to the hanger bracket 400 and above the gutter 214 in a tiered, stair-step manner, to guard the gutter 214.

The method can also include installing the gutter 214, the upper gutter cover 202, and the lower gutter cover 204 seamlessly. The method can also include installing the gutter 214, the upper gutter cover 202, and the lower gutter cover 204 without touching and connectivity to any shingles on the roof. The method can also include installing the gutter 214, the upper gutter cover 202, and the lower gutter cover 204 and allowing an approximate one-eighth inch gap between the gutter 214 and the upper gutter cover 202 to prevent water return.

Figure 5:
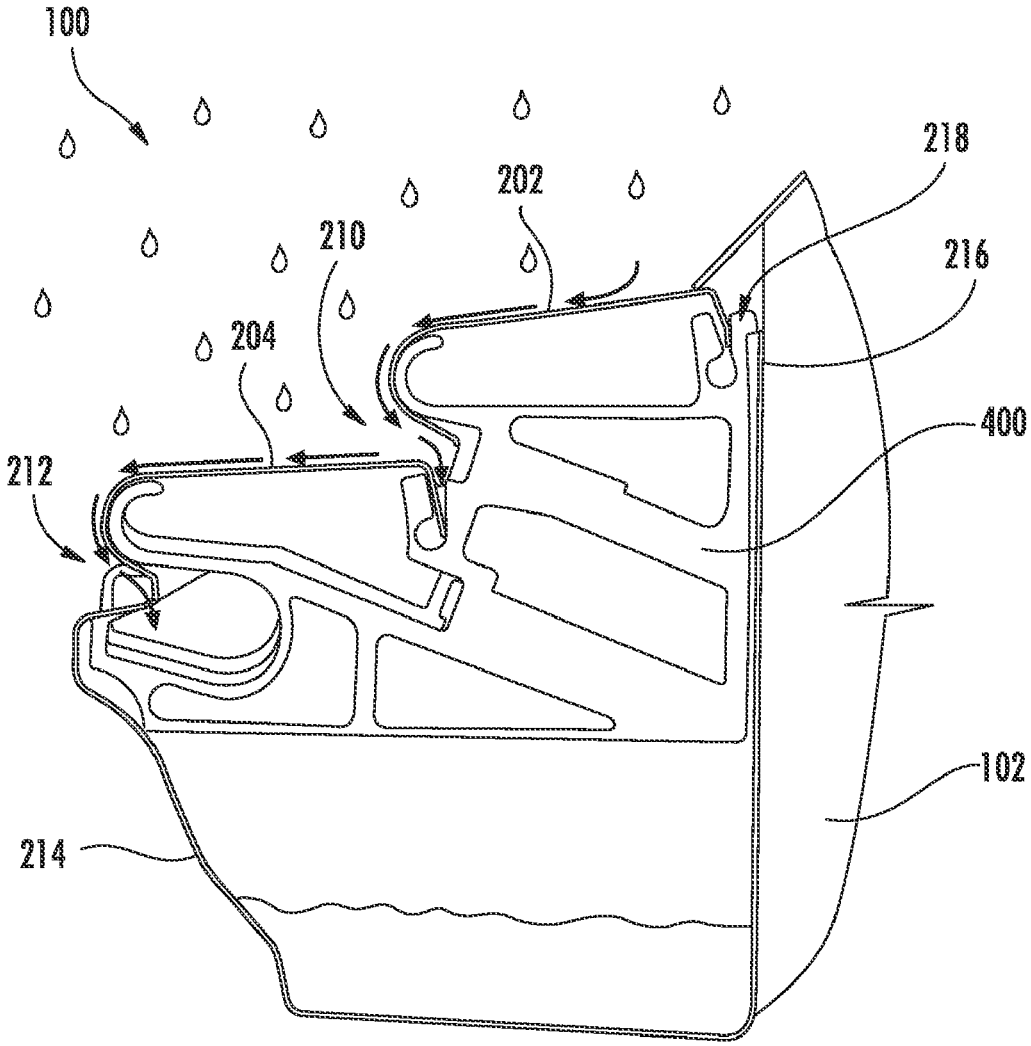
FIG. 5 is a side cross-sectional view of the gutter system depicted in FIG. 1, illustrating, in particular, the relationship of the gutter system hanger depicted in FIGS. 3 and 4, within the gutter system, and the rainwater flow over the two gutter covers and into their respective gutter entry points, according to an embodiment of the technology described herein.
Figure 6:
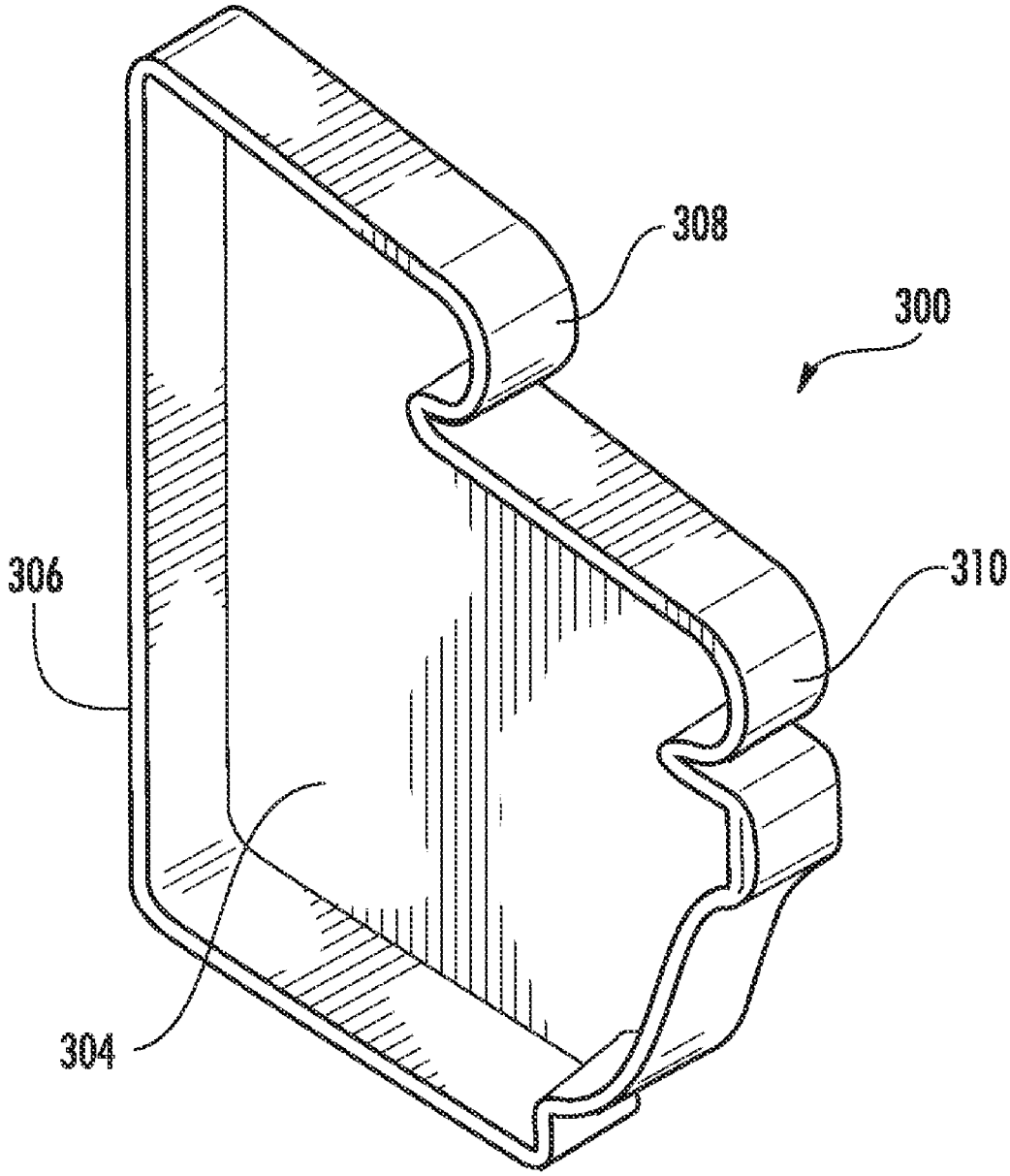
FIG. 6 is a front perspective view of a gutter system end cap, illustrating, in particular, the end cap panel, rim, and rounds, according to an embodiment of the technology described herein.
Figure 7:
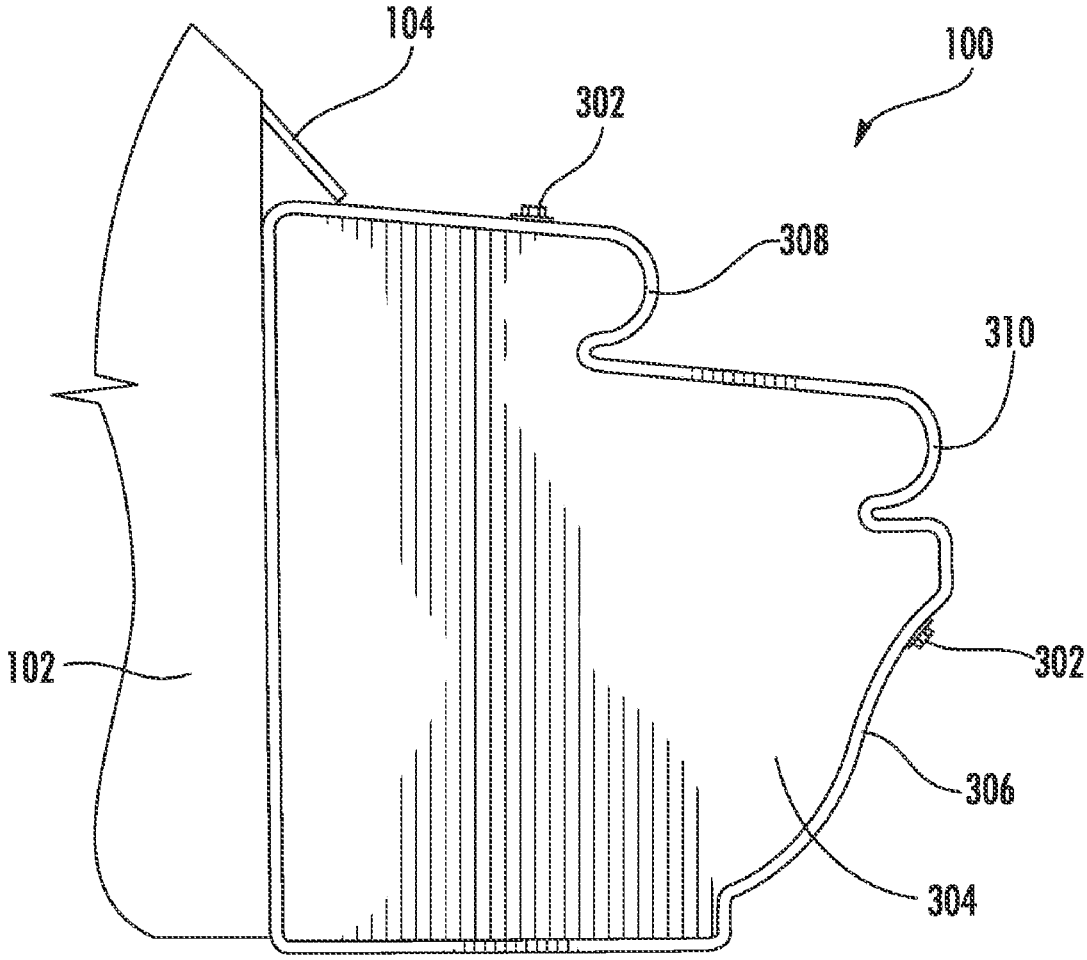
FIG. 7 is a side view of the gutter system end cap depicted in FIG. 6, illustrating, in particular, the relationship of the end cap and gutter system to relative to a fascia board and shingles.
Figure 8:
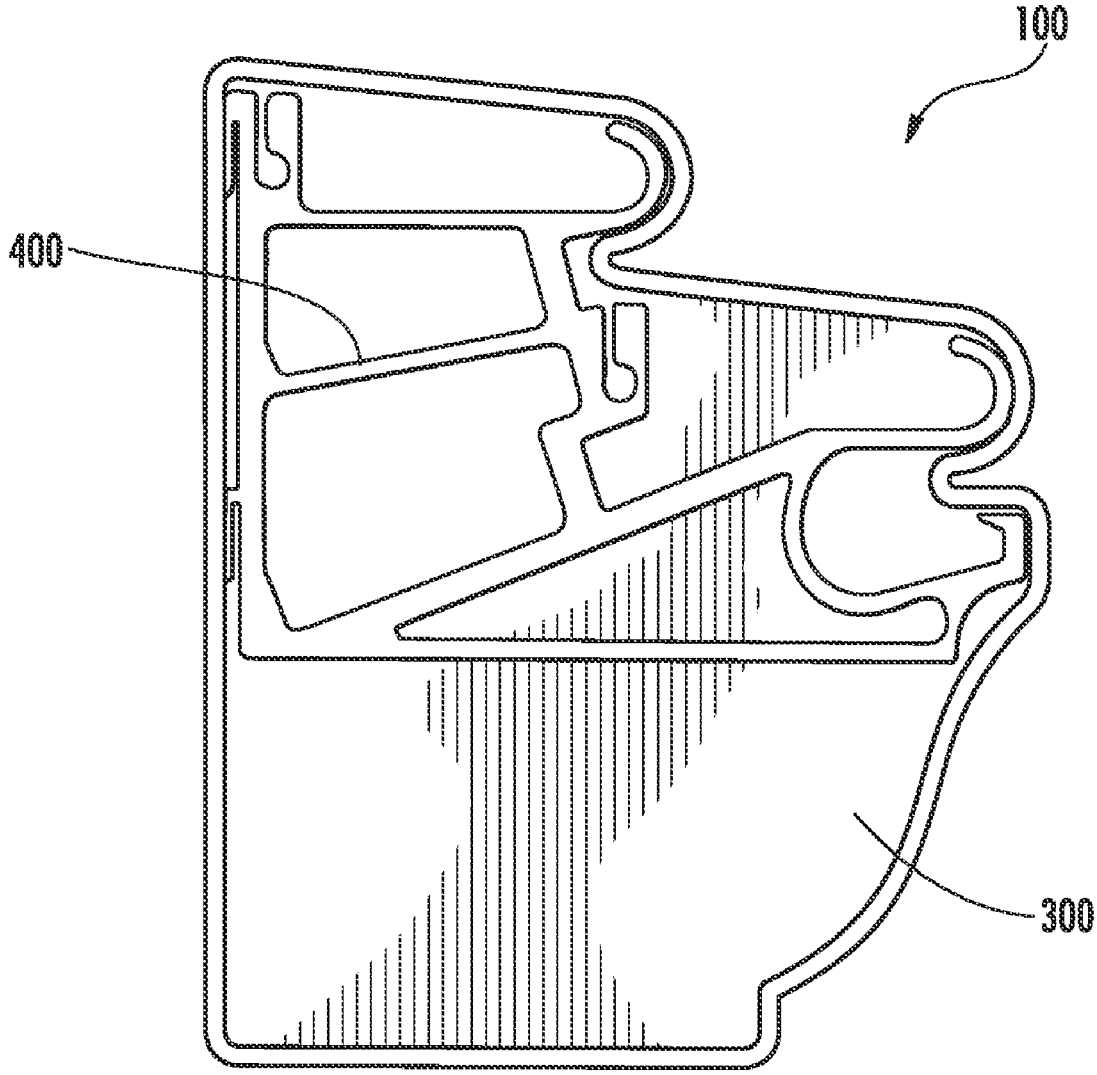
FIG. 8 is a side view of the gutter system including the end cap and gutter system hanger and their interrelationship, according to an embodiment of the technology described herein.

Referring now specifically to FIG. 5, rainwater runoff flow is illustrated on a building having the gutter system 100 described and illustrated herein. The upper gutter cover 202 and the lower gutter cover protect the gutter 214 from entry of leaves and other debris. Rainwater runoff flows downwardly over the upper gutter cover 202 and into entry point 210. Rainwater runoff flows downwardly over the lower gutter cover 204 and into entry point 212. High back 216 prevents the return of water or the entry of an animal, or the like, into the building. Gap 218 ensures that any water hitting against high back 216 drains downwardly into the gutter 214 for proper drainage.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A gutter system hanger comprising:

a hanger bracket configured to secure a gutter to a building having a roof and rainwater runoff, and configured to secure an impermeable, solid upper gutter cover over which rainwater runoff flows into a first entry point for water and an impermeable, solid lower gutter cover over which rainwater runoff flows into a second entry point for water, in a tiered, stair-step manner, to the gutter to guard the gutter from entry of leaves, debris, pine needles, and twigs, and to prevent water and rodents and other animals from entry into the building in and around the gutter;

an upper hanger round defined upon the hanger bracket and configured to receive the upper gutter cover and create the first entry point for water into the gutter; and a lower hanger round defined upon the hanger bracket and configured to receive the lower gutter cover and create the second entry point for water into the gutter.

2. The gutter hanger system of claim 1, further comprising:

at least one hanger mount defined upon a back side of the hanger bracket and with which to secure the hanger bracket to a fascia board on the building.

3. The gutter hanger system of claim 1, further comprising:

at least one channel defined within the hanger bracket in which to receive a mount screw and with which to secure the hanger bracket to a fascia board on the building.

4. The gutter hanger system of claim 1, further comprising:

an upper cover channel defined within the hanger bracket and configured to receive an upper edge of the upper gutter cover; and a lower cover channel defined within the hanger bracket and configured to receive an upper edge of the lower gutter cover.

5. The gutter hanger system of claim 1, further comprising:

an upper cover tuck area defined within the hanger bracket and configured to receive a lower edge of the upper gutter cover; and a lower cover tuck area defined within the hanger bracket and configured to receive a lower edge of the lower gutter cover.

6. The gutter hanger system of claim 1, wherein the hanger bracket is manufactured from a metal selected from a group consisting of: aluminum, copper, and steel.

7. The gutter hanger system of claim 1, wherein the hanger bracket is manufactured from a thermoplastic material.

8. The gutter hanger system of claim 1, wherein the hanger bracket is manufactured from acrylonitrile butadiene styrene (ABS).

9. A gutter system comprising:

a gutter;

an impermeable, solid upper gutter cover;

an impermeable, solid lower gutter cover;

a hanger bracket configured to secure a gutter to a building having a roof and rainwater runoff, and configured to secure the impermeable, solid upper gutter cover over which rainwater runoff flows into a first entry point for water and the impermeable, solid lower gutter cover over which rainwater runoff flows into a second entry point for water, in a tiered, stair-step manner, to the gutter to guard the gutter from entry of leaves, debris, pine needles, and twigs, and to prevent water and rodents and other animals from entry into the building in and around the gutter;

an upper hanger round defined upon the hanger bracket and configured to receive the upper gutter cover and create the first entry point for water into the gutter; and a lower hanger round defined upon the hanger bracket and configured to receive the lower gutter cover and create the second entry point for water into the gutter.

10. The gutter system of claim 9, further comprising:

an end cap for use in a gutter section defined as an end, wherein the end cap further is defined with an upper round, a lower round, and a gutter end shape to enable a secure, sealed fit.

11. The gutter system of claim 9, further comprising:

a high back defined by the placement of the hanger bracket and the gutter against a fascia board such that a surface directly against the fascia board forms the high back configured to prevent water from entering the area behind the gutter system and preventing rodents, or the like, from entering the building.

12. The gutter system of claim 9, wherein the gutter, the upper gutter cover, and the lower gutter are seamless.

13. The gutter system of claim 9, further comprising:

at least one hanger mount disposed upon a back side of the hanger bracket and with which to secure the hanger bracket to a fascia board on the building.

14. The gutter system of claim 9, further comprising:

at least one channel defined within the hanger bracket in which to receive a mount screw and with which to secure the hanger bracket to a fascia board on the building.

15. The gutter system of claim 9, further comprising:

an upper cover channel defined within the hanger bracket and configured to receive an upper edge of the upper gutter cover; and a lower cover channel defined within the hanger bracket and configured to receive an upper edge of the lower gutter cover.

16. The gutter system of claim 9, further comprising:

an upper cover tuck area defined within the hanger bracket and configured to receive a lower edge of the upper gutter cover; and a lower cover tuck area defined within the hanger bracket and configured to receive a lower edge of the lower gutter cover.

17. A method for protecting gutters from debris other than rainwater runoff, the method comprising:

installing a gutter system comprising a gutter, an impermeable, solid upper gutter cover, an impermeable, solid lower gutter cover, a hanger bracket configured to secure a gutter to a building having a roof and rainwater runoff, and configured to secure the impermeable, solid upper gutter cover over which rainwater runoff flows into a first entry point for water and the impermeable, solid lower gutter cover over which rainwater runoff flows into a second entry point for water, in a tiered, stair-step manner, to the gutter to guard the gutter from entry of leaves, debris, pine needles, and twigs, and to prevent water and rodents and other animals from entry into the building in and around the gutter; and an upper hanger round defined upon the hanger bracket and configured to receive the upper gutter cover and create the first entry point for water into the gutter; and a lower hanger round defined upon the hanger bracket and configured to receive the lower gutter cover and create the second entry point for water into the gutter;

securing the gutter to the building with the hanger bracket; and securing the upper gutter cover and the lower gutter cover to the hanger bracket and above the gutter in a tiered, stair-step manner, to guard the gutter.

18. The method of claim 17, further comprising:

installing the gutter, the upper gutter cover, and the lower gutter cover seamlessly; and installing the gutter, the upper gutter cover, and the lower gutter cover without touching and connectivity to any shingles on the roof.

19. The method of claim 18, further comprising:

installing the gutter, the upper gutter cover, and the lower gutter cover and allowing an approximate one-eighth inch gap between the gutter and the upper gutter cover to prevent water return.

* * * * *